US008360264B2

(12) United States Patent
Tuominen et al.

(10) Patent No.: US 8,360,264 B2
(45) Date of Patent: Jan. 29, 2013

(54) CONTAINING ELONGATE BULK PRODUCTS

(75) Inventors: Jay Michael Tuominen, Plymouth, MN (US); Craig Arko, Apple Valley, MN (US); Randy Koch, Minnetonka, MN (US)

(73) Assignee: Koch Industries, Inc., Minneapolis, MN (US)

( * ) Notice: Subject to any disclaimer, the term of this patent is extended or adjusted under 35 U.S.C. 154(b) by 0 days.

(21) Appl. No.: 12/343,650

(22) Filed: Dec. 24, 2008

(65) Prior Publication Data

US 2010/0155281 A1 Jun. 24, 2010

(51) Int. Cl.
*B65D 85/00* (2006.01)

(52) U.S. Cl. ..... 220/631; 206/349

(58) Field of Classification Search ..... 206/349, 206/738, 762, 229, 348, 388, 389, 409; 220/675, 220/631; D9/431
See application file for complete search history.

(56) References Cited

U.S. PATENT DOCUMENTS

| | | | | | |
|---|---|---|---|---|---|
| 1,020,152 | A * | 3/1912 | Musk | 206/409 |
| 2,718,303 | A * | 9/1955 | Polglase | 206/394 |
| 3,193,179 | A * | 7/1965 | Bogren | 229/123.2 |
| 5,071,277 | A * | 12/1991 | Braun | 401/126 |
| 5,111,938 | A * | 5/1992 | Soprano et al. | 206/386 |
| D326,945 | S | 6/1992 | Howitt | |
| D330,328 | S | 10/1992 | DiSesa | |
| 5,165,316 | A | 11/1992 | Hayes | |
| D334,453 | S | 3/1993 | Koloski | |
| 5,201,419 | A * | 4/1993 | Hayes | 206/409 |
| D336,243 | S | 6/1993 | Evans | |
| 5,293,998 | A | 3/1994 | George | |
| D350,900 | S | 9/1994 | Goetz | |
| D351,701 | S | 10/1994 | Sawatsky | |
| 5,465,521 | A * | 11/1995 | Baker et al. | 206/5 |
| D386,904 | S | 12/1997 | Bradshaw | |
| D429,882 | S | 8/2000 | Lee et al. | |
| 6,394,301 | B1 * | 5/2002 | Koch | 220/646 |
| 6,530,495 | B1 * | 3/2003 | Joseph | 220/553 |
| 6,715,608 | B1 * | 4/2004 | Moore | 206/397 |
| D515,313 | S | 2/2006 | Uffner et al. | |
| D535,478 | S | 1/2007 | Uffner et al. | |
| D544,169 | S | 6/2007 | Jones | |
| 2006/0169696 | A1 * | 8/2006 | Taylor | 220/326 |
| 2008/0099353 | A1 * | 5/2008 | Parsons et al. | 206/266 |

* cited by examiner

*Primary Examiner* — Steven A. Reynolds
*Assistant Examiner* — King M Chu
(74) *Attorney, Agent, or Firm* — Hamre, Schumann, Mueller & Larson, P.C.

(57) ABSTRACT

Some embodiments of a container can be configured to transport chain or other elongate bulk products and to thereafter display the chain or other elongate bulk products in a manner that provides enhanced visibility to consumers. In some circumstances, the container may be tiltable to shift from a storage position to a display position. Also, the container may be nestable with other containers when stacked during storage.

22 Claims, 6 Drawing Sheets

CONTAINING ELONGATE BULK PRODUCTS

TECHNICAL FIELD

This disclosure relates to containers for elongate bulk products, such as chain bin containers for transporting and displaying chain material.

BACKGROUND

Chain and other elongate bulk products can be provided in containers for display at retail establishments. A worker may have difficulty of transferring continuous lengths of chain from a shipping container to a different display container. As such, the chain containers are often used both to store the goods during transport and to display the goods at the retail establishment. For example, cylindrical pails or rectangular box containers may be used to transport chain to a retail establishment for subsequent display to customers. In some circumstances, these containers can carry hundreds of pounds of chain material, which may create difficulties for a worker attempting to grasp and lift the containers. Many of the cylindrical pails or rectangular box containers for displaying chain include a lid over a top opening. The lid can be removed to display the chain products therein, but the upward-facing opening is not necessarily convenient for customers attempting to view into a container that is arranged on a store shelf

SUMMARY

Some embodiments of a container can be arranged in a first orientation to transport chain or other elongate bulk products and arranged in a second orientation to display the chain or other elongate bulk products in a manner that provides visibility to consumers. For example, the container may rest on a first bottom wall when arranged in a storage position (e.g., to store or transport the chain) and may tilted to rest on a secondary bottom wall when arranged in a display position (e.g., to display the chain to consumers or other users). Moreover, the container may nest with other containers when stacked during storage (e.g., when stored in a warehouse room, when stored during transport, or the like), thereby conserving storage space and promoting a secure stacking configuration. In such circumstances, the container body may include one or more reinforcing members integrally formed therein so as to provide structural integrity under the load of stacked containers. Also, a number of handles can be arranged at particular locations on the container body so that a user can readily grasp and lift the container regardless of whether the container is in the storage position or in the display position.

Particular embodiments include a transport and display container for an elongate chain product. The container may include a container body that contains an elongate chain product, the container body being at least partially defined by a front wall, a rear wall, side walls, a first bottom wall that extends generally perpendicular to the front wall and rear wall, and a secondary bottom wall that extends transversely between the front wall and the first bottom wall. The container may also include a lid that is releasably engaged with the container body so as to at least partially enclosed the elongate chain product therein. The container body may be tiltable from a storage position in which the container body rests on the first bottom wall to a display position in which the container body rests of the secondary bottom wall so as to direct a chain-dispensing opening to face in a non-vertical orientation.

In some embodiments, a container for transporting and displaying an elongate bulk product may include a container body that contains an elongate bulk product in an interior space. The container body may be at least partially defined by a front wall, a rear wall, side walls, a first bottom wall that extends generally perpendicular to the front wall and rear wall, and a secondary bottom wall that extends transversely between the front wall and the first bottom wall. The container may also include a lid that is releasably engaged with the container body so as to at least partially enclosed the elongate bulk product therein. At least a portion of the lid may be removable to reveal a product-dispensing opening. The container body may be adjustable from a storage position in which the first bottom wall extends in a horizontal direction adjacent to a support surface to a display position in which the first bottom wall extends in a non-horizontal direction while secondary bottom wall is adjacent to the support surface. The product-dispensing opening may face in a forwardly tilted orientation when the container body is adjusted to the display position and the portion of the lid is removed.

Other embodiments may include a method of handling elongate chain product in a chain container. The method may include adjusting a chain container from a storage position in which a first bottom surface of the chain container is adjacent to a shelf surface to a display position in which a secondary bottom surface of the chain container is adjacent to the shelf surface. The chain container may define an interior space that contains an elongate chain product. The method may also include removing at least a portion of a lid of the chain container so as to reveal a chain-dispensing opening that provides access to the elongate chain product in the interior space. The chain-dispensing opening may be arranged in a forwardly tilted orientation so that the elongate chain product is viewable to a consumer positioned proximate to a front of the shelf the surface.

These and other embodiments described herein may provide one or more of the following benefits. First, some embodiments of the container can be adjustable from a first orientation in which chain or other elongate bulk products are stored therein to a second different orientation in which the chain or other elongate bulk products are displayed to consumers. For example, the container can be tiltable such that the container rests on a first bottom wall when in a storage position (e.g., during storage or transport) and rests on a secondary bottom wall when in a display position (e.g., during display of the elongate bulk product to consumers). Second, the container can be nestable with other like containers so that a plurality of the container can be conveniently transported and stored together in a stacked configuration that reduces the storage space footprint and reduces the likelihood of improper or unsafe storage practices. Third, the container can include a plurality of handles arranged on the container body so that a first pair of handles is exposed to a user when the container is in the storage position and a second pair of handles is exposed to the user when the container is in the display position. Thus, the container can be readily lifted or adjusted by the user regardless of whether the container rests upon the first bottom wall or the secondary bottom wall. Fourth, the container can include a lid portion that is removable to reveal a dispensing window that provides access to the chain or other elongate bulk product stored in the interior space. In such circumstances, the entire lid need not be removed from the container body, but instead a removable portion of the lid can be readily removed by the user in a manner that also causes a free end of the chain to rest proximate to the dispensing window. Fifth, the container can be configured with a durable and reinforced construction that permits reusability of the container after the elongate bulk product is exhausted. Moreover, the reinforced configuration of the container body can endure significant loading from a plurality of similar containers filled with chain material and stacked on top of one another.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
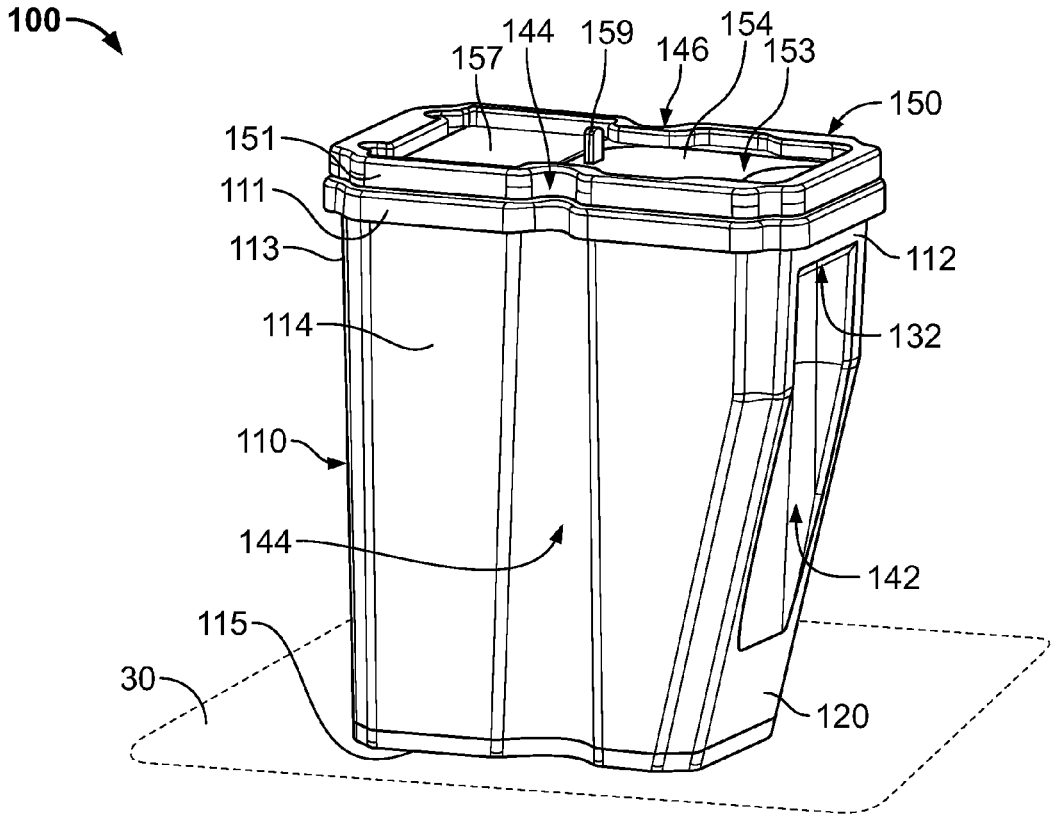
FIG. 1 is a perspective view of a container arranged in a first orientation, in accordance with some embodiments.
Figure 2:
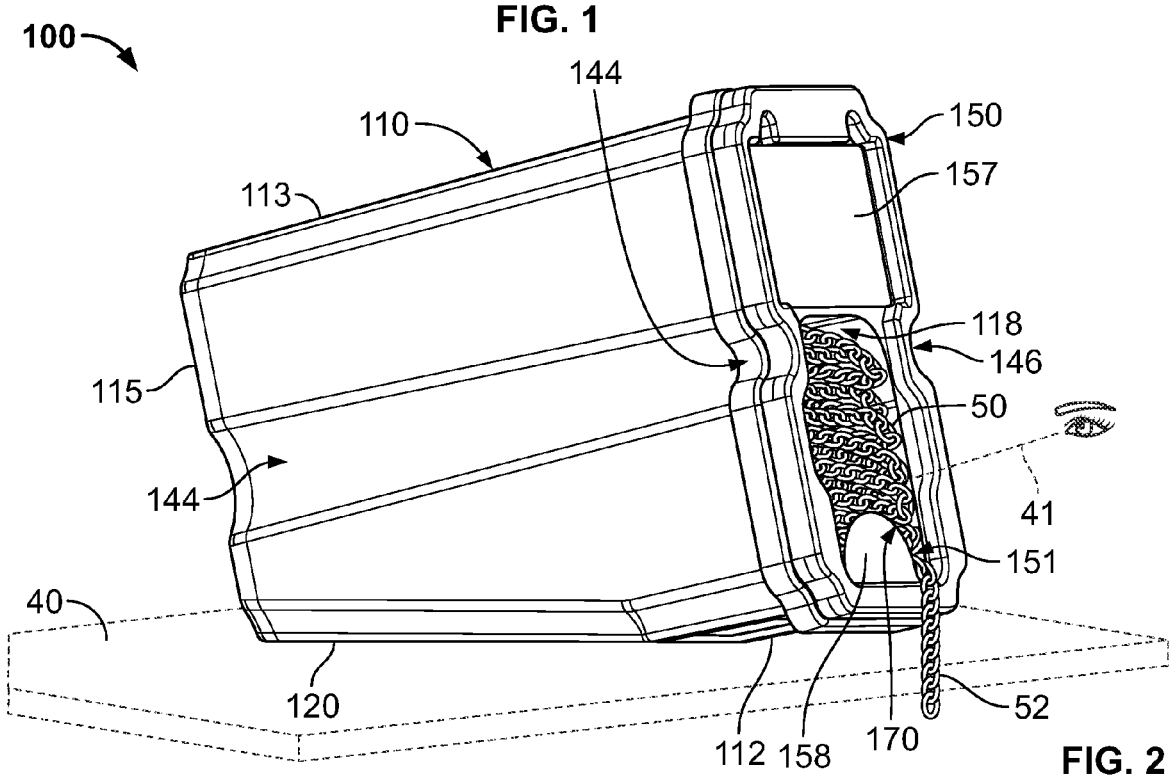
FIG. 2 is a perspective view of the container of FIG. 1 arranged in a second orientation, in accordance with some embodiments.

Referring to FIGS. 1-2, a container 100 can be configured to store an elongate chain product 50 during transport and to display the chain product 50 to consumers. The container 100 can be arranged in a first orientation (e.g., a storage position as shown in FIG. 1) to transport the chain product 50 and also can be arranged in a second orientation (e.g., a display position as shown in FIG. 2) to display the chain product 50 in a manner that provides enhanced visibility to consumers. For example, the container 100 can be tilted or otherwise adjusted from the storage position as shown in FIG. 1 (e.g., to store or transport the chain product 50) in which the container 100 rests on its first bottom wall 115 to the display position as shown in FIG. 2 (e.g., to present the chain product 50) in which the container 100 rests on its secondary bottom wall 120. As described in more detail below, the storage position of the container 100 can be useful when transporting a plurality of the containers in a manner that conserves storage space and provides secured, nested configuration (refer, for example, to FIG. 10). When the container 100 is arranged on a shelf or other fixture for display of the chain product 50 to consumers, the display position of the container 100 can be useful to orient the chain-dispensing opening toward the consumers' line of sight and readily reveal the chain product 50 therein (refer, for example, to FIG. 2).

The container 100 can include a container body 110 and a lid 150 that at least partially define an interior space 118 of the container 100. The interior space 118 can contain a selected quantity of the chain product 50 therein. For example, the chain product 50 can include a continuous length of chain that amounts to more than 20 lbs, about 20 lbs to about 300 lbs, and about 50 lbs to about 100 lbs in this embodiment. For example, the chain product 50 may comprise welded chain grade 43, grade 30, grade 70, or the like. It should be understood that, in other embodiments, the interior space 118 of the container 100 can receive an elongate bulk product other than chain, such as cable, wire, rope, cordage, or the like. For example, the container 100 can store an elongate steel cable product in a manner that is convenient to workers and can display the elongate steel cable product in a manner that provides enhanced visibility to consumers.

In some embodiments, the container 100 (e.g., the container body 110 and the lid 150) can be constructed using durable materials that permit reusability of at least the container body 110 after the elongate chain product 50 is exhausted. Moreover, the container 100 can be constructed with a reinforced configuration (described in more detail below in connection with FIGS. 5-6) that can endure significant loading from a plurality of similar containers filled with chain material and stacked on top of one another. For example, the container 100 may comprise high-density polypropylene, high-density polyethylene (HDPE), polyvinyl chloride (PVC), acrylonitrile butadiene styrene (ABS), or other moldable polymer materials. In alternative embodiments, the container 100 can comprise steel or other metal materials that permit re-usability of at least the container body 110.

Still referring to FIGS. 1-2, the container body 110 can include a front wall 112 that generally opposes a rear wall 113, a side wall 114 that generally opposes another side wall 116 (FIG. 5), the first bottom wall 115, and the secondary bottom wall 120. In some embodiments, the secondary bottom wall 120 extends generally transverse to the first bottom wall 115. In such circumstance, the container 100 is not necessarily a box-shaped structure, but can instead provide a generally five-sided cross-sectional shape (refer, for example, to FIGS. 7-8). In the depicted embodiment, the first bottom wall 115 extends generally perpendicular from the rear wall 113 toward the front wall 112. Also in this embodiment, the secondary bottom wall 120 extends transversely between the front wall 112 and the first bottom wall 115. Such a transverse configuration of the first bottom wall 115 and the secondary bottom wall 120 permits the container 100 to be readily adjusted from the storage position (e.g., FIG. 1) to the display position (e.g., FIG. 2) in which the chain-dispensing opening is oriented at a tilted angle toward the consumers. In some embodiments, the secondary bottom wall 120 can extend transversely away from the first bottom wall 115 at non-perpendicular angle, such as about 1000 to about 1600, about 1050 to about 1300, and about 1100 to about 1200 in this embodiment. As such, when the secondary bottom wall 120 rests on a shelf or other support surface 40, the front wall 112 and the first bottom wall 115 extend transversely upward from the support surface 40 (as shown, for example, in FIG. 2). This configuration allows the chain-dispensing window 170 (FIG. 2) to be arranged in a forwardly tilted orientation so that the chain product 50 can be readily presented in the consumer's line of sight 41.

In some embodiments, the container 100 can be stored as shown in FIG. 1 with the first bottom wall 115 against a surface 30 (e.g., a warehouse floor or shelf, a shipping pallet during transport, or the like) until it is desired to display the contents of the container 100 to potential consumers. To display the contents of the container 100 toward the consumers' line of sight, the container 100 can be arranged on a shelf 40 such that the lid 150 is facing potential customers. In some embodiments, the container 100 can be tipped or otherwise adjusted such that the secondary bottom wall 120 abuts the shelf 40, and at least a portion of the lid 150 can be removed to provide the chain-dispensing window 170 that is arranged in the forwardly tilted orientation (refer, for example, to FIG. 2). In such circumstances, the chain product 50 therein can be revealed to increase the visibility of the chain product 50 to consumers.

Figure 3:
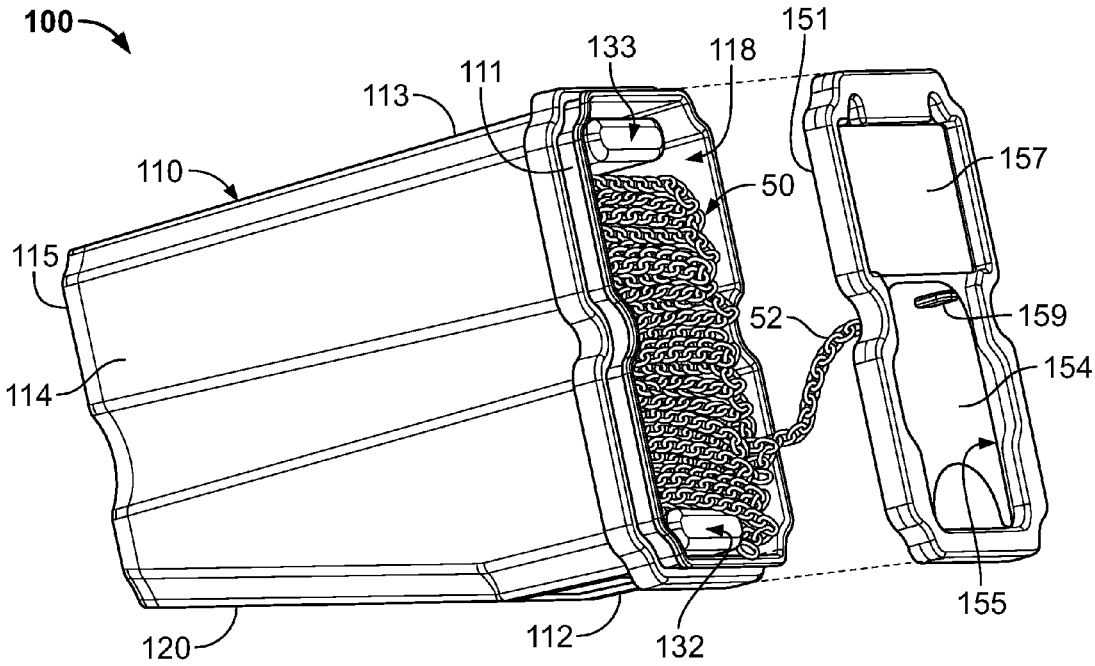
FIGS. 3-4 are perspective exploded views of the container of FIG. 1.
Figure 4:
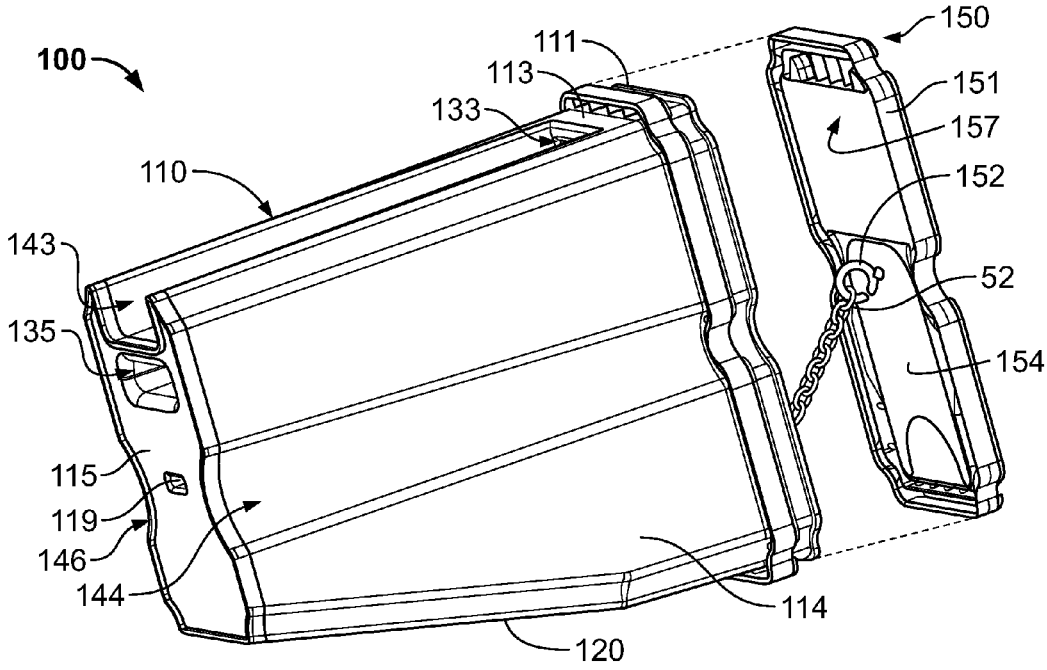

Referring now to FIGS. 3-4, some embodiments of the container body 110 can include a rim 111 in a top portion of the container body 110 that is generally opposite the first bottom wall 115. The rim 111 can define an upper opening in the container body 110 that provides access to the interior space 11 8. The rim 111 can be configured to mate with a corresponding rim 151 defined by the lid 150, allowing the lid 150 to be removably coupled to the container body 110 (described in greater detail below in connection with FIGS. 7-9). For example, the lid 150 may not be coupled to the container body 110 until the interior space 118 receives an elongate bulk product (e.g., chain product 50 or the like) intended for dispensation to a user. When the chain product 50 is positioned within the interior space 118, the lid 150 can be coupled to the container body 110 by mating at least a portion of the rim 111 of the container body 110 to the corresponding rim 151 in the lid. In such circumstances, the chain product 50 may be secured inside the container 100 during storage (e.g., when stored in a warehouse room, when stored during transport, or the like).

In some embodiments, the container 100 can include features that simplify the display and sale of the chain product 50. For example, the container 100 can be tiltable from the storage position shown in FIG. 1 (e.g., to store or transport the chain product 50) to the display position shown in FIG. 2 (e.g., to provide enhanced visibility of the chain product 50 to potential consumers). When in the storage position, the container can rest on its first bottom wall 115. When adjusted to the display position, the container 100 container can rest on its secondary bottom wall 120. To increase the visibility of the chain product 50 to potential consumers, the lid 150 can include a removable portion 154 that can be removed by a worker, for example, to provide access to the chain product 50 therein. When the removable portion 154 is removed from the lid 150, the chain product 50 can be viewed and accessed by potential consumers, allowing consumers to remove only a selected amount of the chain product 50. The periphery 155 of the removable portion 154 may include a weakened portion so that the removable portion 154 can readily separate from the remaining lid 150. For example, the removable portion 154 may be separate from, and not connected to, the lid 150, with the exception of one or more breakaway tabs distributed around the perimeter 155. The lid 150 can be molded in such a way that the removable portion 154 is only connected to the lid 150 via the one or more tabs. In another example, the perimeter 155 may be scored or molded to include a cut line to facilitate separation of the removable portion 154. In this configuration, a user can readily separate the removable portion 154 from the remainder of the lid 150 (e.g., by breaking the tabs, applying a separation force on the removable portion 154 to separate the perimeter 155, or the like) to reveal the interior space 118 and the chain product 50 therein (refer, for example, to FIG. 2). The remaining portion 157 of the lid 150 (e.g., after the removable portion 154 has been removed) can be configured to maintain the chain product 50 inside the container 100 while allowing a desired amount to be removed. The product-dispensing window 170 (FIG. 2) can be defined by the opening in the remaining portion 157 of the lid 150 after the removable portion 154 is separated from the lid 150.

Still referring to FIGS. 3-4, some embodiments of the lid 150 can include an inwardly facing connection link 152 so as to draw out a free end 52 of the chain when the removable portion 154 is separated from the lid 150. For example, the connection link may include eye-hook 152 that extends inwardly into the internal space 118 when the removable portion 154 is coupled to the lid 150. When the removable portion 154 of the lid 150 is removed and withdrawn from the container body 110, the free end 52 of the chain product 50 connected to the eye-hook 152 is simultaneously pulled from the interior space 118 and out of the product-dispensing window 170 (refer, for example, to FIG. 2). As such, the free end 52 of the chain product 50 becomes readily accessible to the user upon removal of the lid portion 154.

In this embodiment in which the removable portion 154 is connected to the lid 150 by breakaway tabs, the removable portion 154 can be withdrawn from the lid 150 by grasping and pulling on a molded protruding structure 159 in the lid 150. As the removable portion 154 is withdrawn, the free end 52 of the chain product 50 is simultaneously withdrawn from the interior space 118 due to the releasable connection with the eye hook 152 (also described below in connection with FIG. 12). The remaining portion 157 of the lid 150 can include a curved retaining structure 158 (FIG. 2) which defines a lower portion of the product-dispensing window 170. When in the display position shown in FIG. 2, the free end 52 of the chain product 50 may extend outside the container 100 such that one or more links of the chain 50 can rest in a concave region 151 defined the curved retaining structure 158. When in this location, the chain product 50 can be restricted from falling further out of the container 100. Thus, the free end 52 of the chain product 50 is readily graspable by a consumer while a substantial portion of the chain product 50 is retained inside the container 100 by the curved retaining structure 158 and other portions of the lid 150. Moreover, in embodiments in which the contents of the container 100 comprises something other than chain (e.g., elongate cable product), a free end of the elongate product can reside in the region 151 while frictional forces maintain the product substantially in place.

Figure 5:
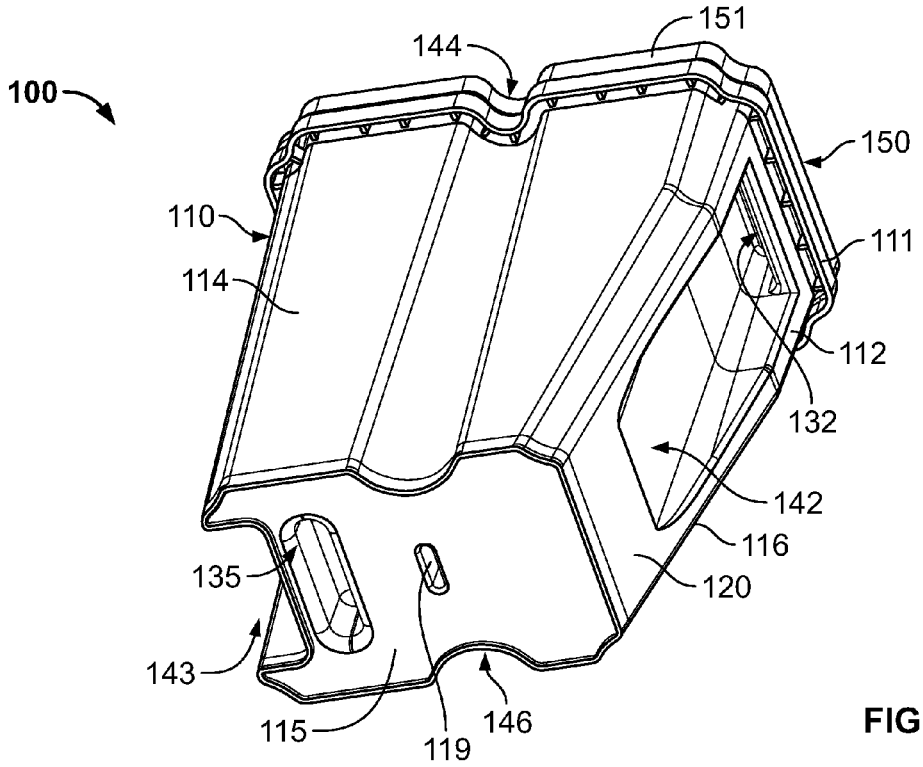
FIGS. 5-6 are further perspective views of the container of FIG. 1.
Figure 6:
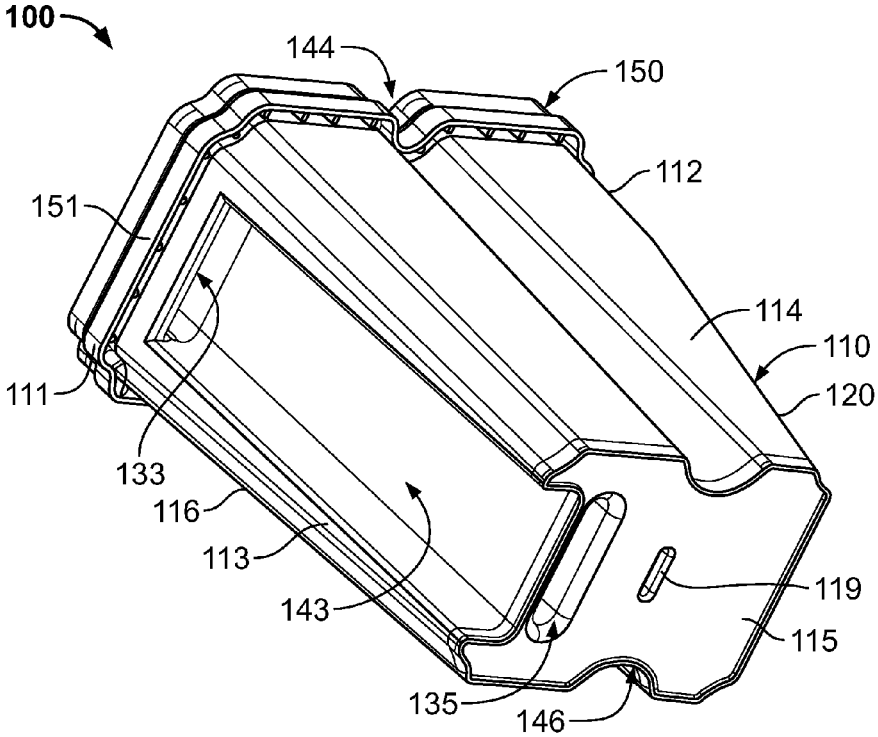

Referring now to FIGS. 5-6, some embodiments of the container 100 may include structural features that can, for example, allow a user to more easily manipulate the position and orientation of the container 100. In some embodiments, the container body 110 can include a front handle 132 in the front wall 112 that is readily graspable, for example, when the container 100 is in the storage position depicted in FIG. 1. Also, the container body 110 can include a bottom handle 135 in the first bottom wall 115 that is readily graspable by a user, for example, when the container 100 is in the display position depicted in FIG. 2. Thirdly, the container body 110 can include a rear handle 133 in the rear wall 113 that is readily graspable by a user, for example, when the container 100 is in either the display position depicted in FIG. 2 or the storage position depicted in FIG. 1. One or more of the handles 132, 133, and 135 can be integrally formed in the container body 110 in a manner that eliminates the need for moving handle parts when stacking or handling the container 100. In some embodiments, the container body 110 can include channels 142 (e.g., in the front wall 112) and 143 (e.g., in the rear wall 113) that enhance the user access to the front and rear handles 132 and 133, respectively. For example, the front and rear channels 142 and 143 may serve guides for a user's hands when reaching for the front and rear handles 132 and 133. Such guides may be particular useful, for example, when the user is wearing gloves.

In the depicted embodiment, the container body 110 can provide at least a pair of handles that are accessible regardless of whether the container 100 is arranged in the storage position or the display position. For example, when the container 100 is in the storage position (FIG. 1), a first handle pair including front and rear handles 132 and 133 can be readily accessible to a user. When the container 100 is in the storage position, one or both of the handles 132 and 133 can be grasped to slide the container 100 along a surface 30 (FIG. 1) adjacent to the first bottom wall 115, to lift the container 100 off the surface 30, to tilt the container 100 from the storage position to the display position, or the like. Similarly, when the container 100 is in the display position (FIG. 2), a different handle pair (including bottom handle 135 and either front or rear handle 132 or 133) can be readily accessed by the user. When the container 100 is in the display position, the bottom handle 135 and one of the front and rear handles 132 and 133 can be grasped to slide the container 100 along the surface 40 (FIG. 2) adjacent the secondary bottom wall 120, to lift the container 100 off the surface 40, to tilt the container 100 from the display position to the storage position, or the like.

Still referring to FIGS. 5-6, some embodiments of the container 100 may include integral structural features that can, for example, increase the strength of the container body 110. For example, the container body 110 may include a plurality of vertically oriented support channels 144 and 146 that are integrally formed in the walls of the container 100. In this embodiment, the support channels 144 and 146 are integrally formed in the opposing side walls 114 and 116 of the container body so as to extend generally vertically from the bottom to the top of the container body 110. The configuration of the support channels 144 and 146 can be selected so as to provide structural support to the container 100 when other containers or items are stacked thereon. For example, the support channels 144 and 1446 may be at least partially defined by curved walls that serve as vertical support columns to reduce the likelihood of bowing or buckling of the sidewalls 114 and 116 when a compressive force is applied to the container 100 (e.g., when heavy objects are stacked thereon). In some circumstances, the support channels 144 and 146 may align with corresponding support channels of stacked containers 100' (described below in connection with FIG. 10) so as to facilitate alignment of the containers 100 and 100' during a stacking operation.

Figure 7:
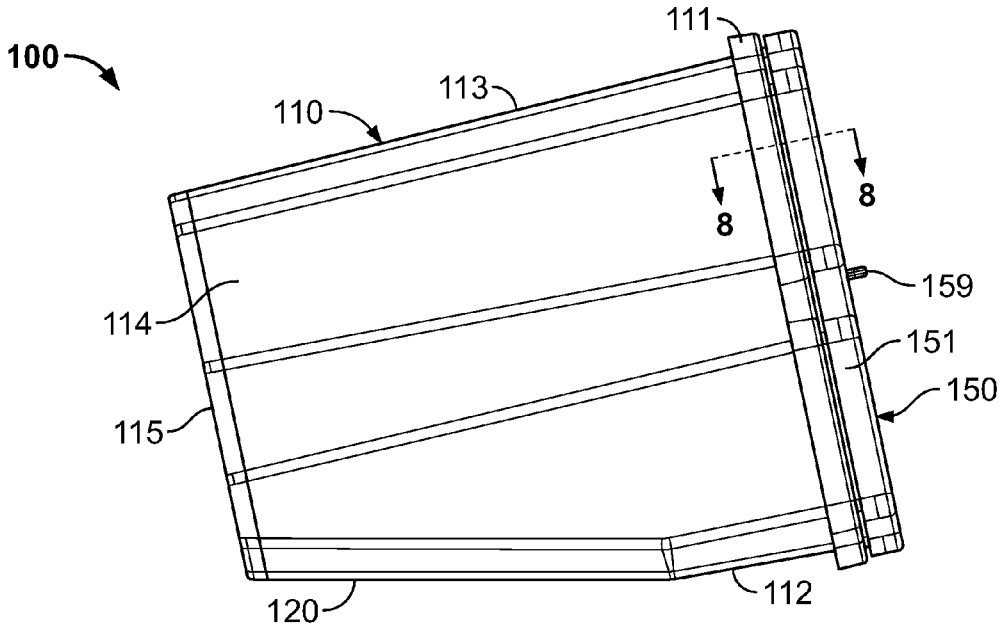
FIG. 7 is a side view of the container of FIG. 1.

Referring now to FIG. 7, the container body 110 can include the secondary bottom wall 120 that extends transversely between the front wall 112 and the first bottom wall 115. Although the first bottom wall 115 and the front wall 112 can be arranged generally perpendicular to one another, the secondary bottom wall 120 may transversely extend from the first bottom wall 115 toward the front wall 112. As such, the container 100 may have a nonrectangular cross-sectional shape. As shown in FIG. 7, the container 100 may have a generally five-sided cross-sectional shape due to the plurality of bottom walls (e.g., first bottom wall 115 and secondary bottom wall 120). For example, the secondary bottom wall 120 can extend transversely away from the first bottom wall 115 at a non-perpendicular angle that is greater than 900, such as about 1000 to about 1600, about 1050 to about 1300, and about 1100 to about 1200 in this embodiment. Such a configuration of the first bottom wall 115 and the secondary bottom wall 120 permits the container 100 to be conveniently tilted from the storage position (e.g., FIG. 1) to the display position (e.g., FIG. 7) in which the chain-dispensing opening is oriented at an upward-tilted angle toward the consumers.

Figure 8:
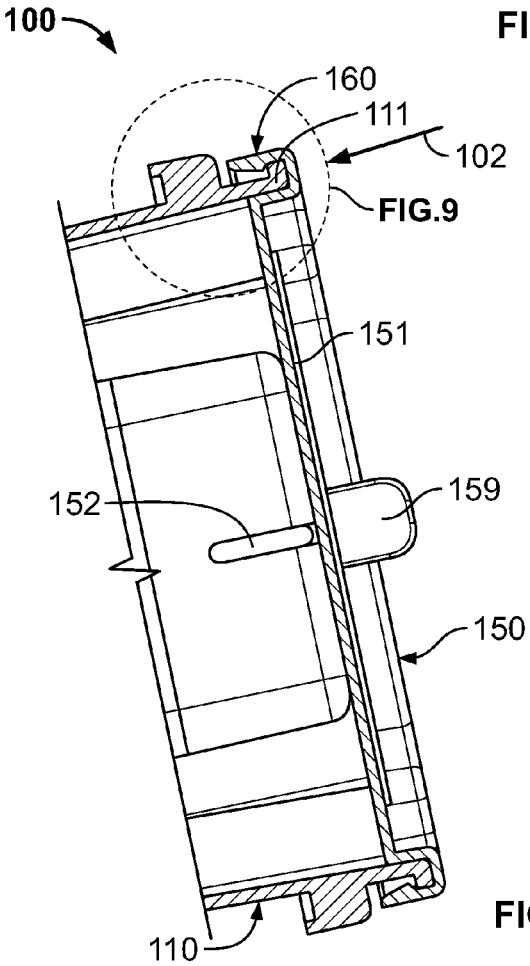
FIG. 8 is a partial cross-sectional view of the container of FIG. 7.
Figure 9:
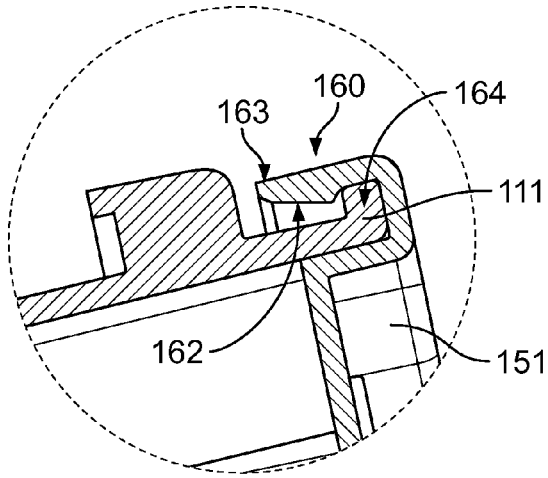
FIG. 9 is a partial cross-sectional view of the container of FIG. 8.

Referring now to FIG. 7-9, in some embodiments, the container body 110 can include the rim 111 that is configured to mate with the corresponding rim 151 of the lid 150 such that the lid 150 can be removably coupled to the container body 110 (e.g., after the container body 110 receives the chain product 50 therein). For example, the rim 151 of the lid 150 can include a tab 160 that extends generally continuously around the perimeter of the lid 150. The lid 150 can be coupled to the container body 110 by forcibly pressing the lid 150 against the container body 110 (e.g., as indicated by arrow 102). As the lid 150 is pressed against the container body 110, a front face 162 of the tab 160 slides along the rim 111, temporarily forcing the end portion 163 of the tab 160 away from the rim 111. By continuing to press the lid 150 in the direction indicated by the arrow 102, the front face 162 will move beyond the rim 111, allowing the tab 160 to snap around the rim 111, thus securing the rim 111 in a pocket 164 of the tab 160. When the lid 150 is mated to the rim 111, the container 100 can retain at least a portion of the chain product 50 in the interior space 118 of the container 100. In some embodiments, the container body 110 can be configured to be re-usable. In such circumstances, the lid 150 can be removed (e.g., to at least partially fill the container body 110 with additional chain product 50). When the additional chain product 50 is received in the container body 110, the lid 150 (or a new lid similar to the lid 150) can be coupled to the container body 110 to retain the chain product 50 inside the container 100. As described previously in connection with FIGS. 3-4, the removable portion 154 of the lid 150 can be removed to reveal the contents of the container 100. In some embodiments, an intact lid 150 (FIG. 1) can be separated from the container body 110 and replaced with a previously used lid 150 (FIG. 2) where the removable portion 154 has been previously removed to reveal the contents of the container 100. In these circumstances, one intact lid 150 can be used during the transport of the container 100, while a different lid 150 can be used to display the contents of the container 100. In this way, when the container 100 is empty, it can be returned to the supplier with an intact lid 150, thus allowing the container 100 to be reused.

Figure 10:
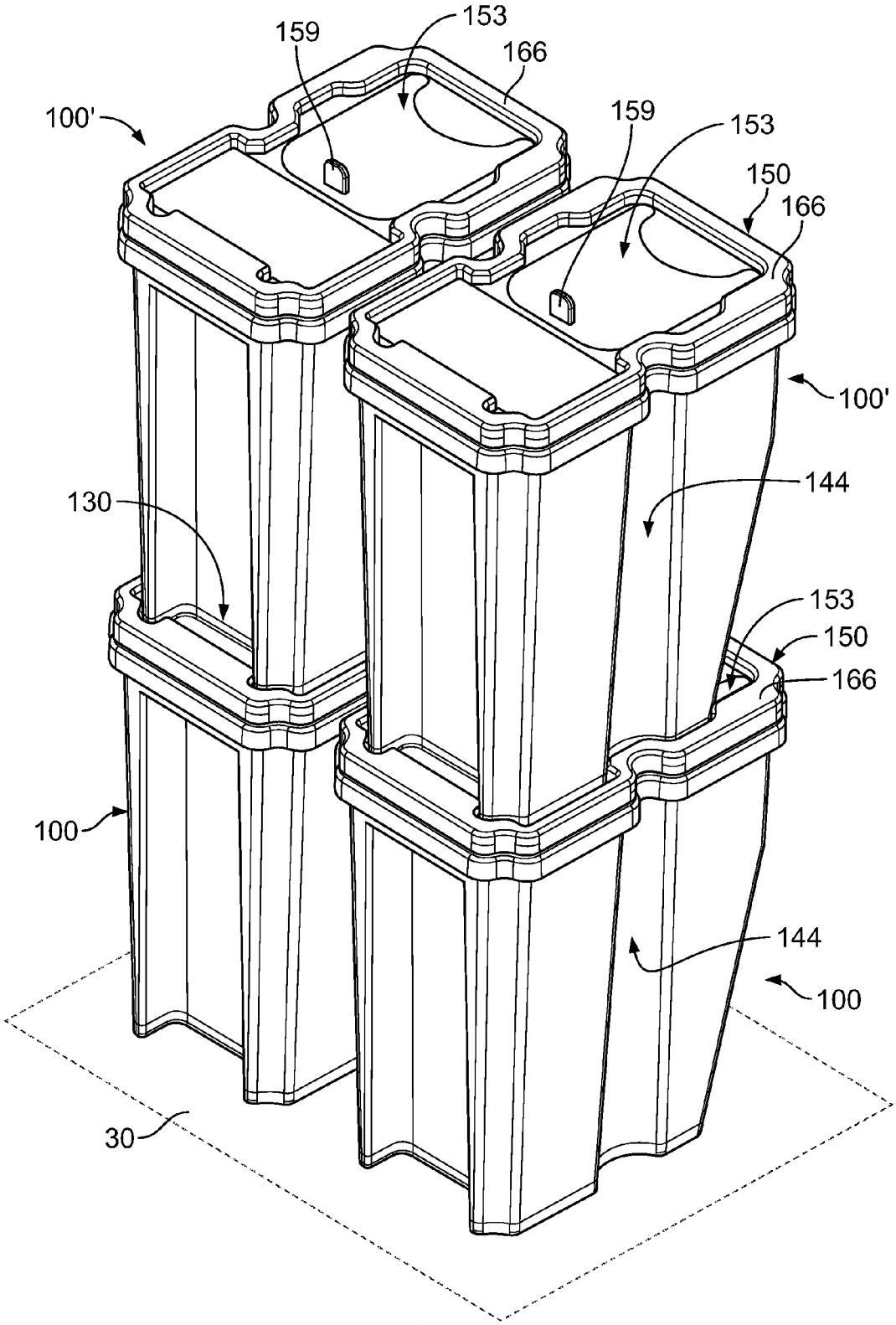
FIG. 10 is a perspective view of a plurality of the containers of FIG. 1 stacked during storage or transport, in accordance with some implementations.

Referring now to FIG. 10, in use, the container 100 can be arranged in a secure stacking configuration that includes a plurality of containers 100 and 100' (e.g., when stored in a warehouse room, when stored during transport, or the like). In such circumstances, the container 100 can be configured for nesting with other containers in a stack. In particular, the container 100 may include a number of integrally formed structural features that facilitate nesting of the containers in a secure stacking configuration.

In some embodiments, the lid 150 can be designed with a raised outer lip 166 and a recessed portion 153 such that a lower portion 130 of one container 100' can nest in a recessed portion 153 of an adjacent container 100. When nested in this configuration, the lip 166 can restrict the horizontal sliding movement of the container 100' stacked on top of the lower container 100, thereby providing a secure stacking configuration that can reduce the likelihood of worker injuries during transport. In addition, other structure features may facilitate the mating arrangement between the upper container 100' and the lower container 100 in the stack. For example, the first bottom surface 115 of the upper container 100' can include an indentation 119 (refer to FIG. 4) to receive the protruding structure 159 of the lower container 100 when one or more containers 100 and 100' are in the stacked configuration. In another example, the support channels 144 and 146 can be configured to have a greater size proximate the first bottom wall 115 (refer to FIGS. 5-6). Thus, as shown in FIG. 10, the top of a support channel 144 in the lower container 100 can fit within the bottom of a corresponding support channel 144 in the upper container 100.

Accordingly, the container 100 can be nestable with other like containers so that a plurality of the containers 100 and 100' can be conveniently transported and stored together in a stacked configuration that reduces the storage space footprint and reduces the likelihood of improper or unsafe storage practices.

Figure 11:
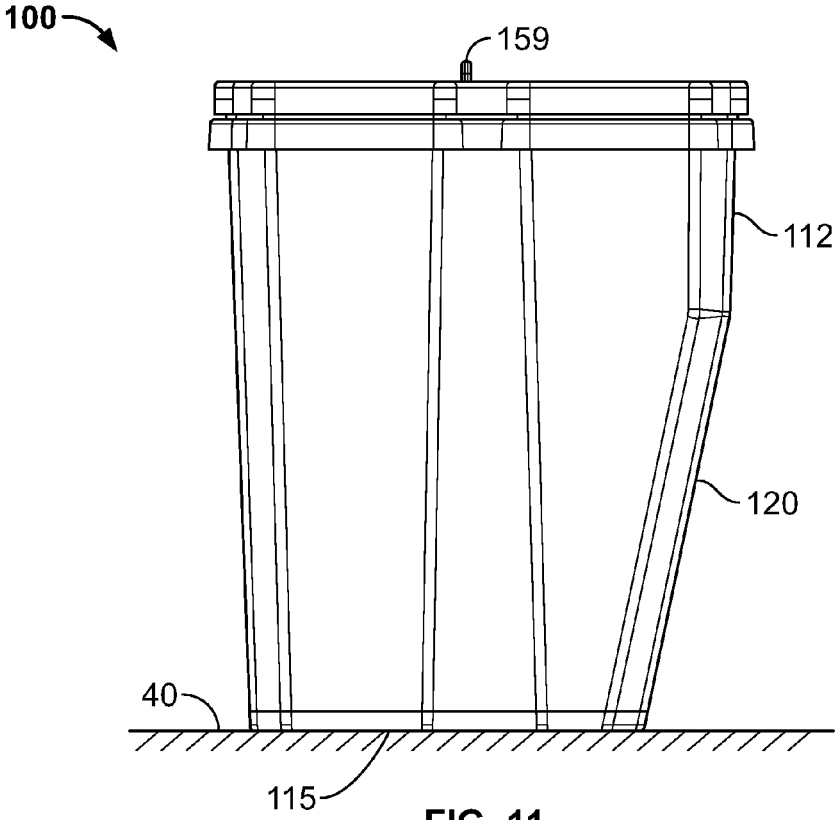
FIGS. 11-12 are side views of the container of FIG. 1 being shifted from a storage position to a display position, in accordance with some implementations.
Figure 12:
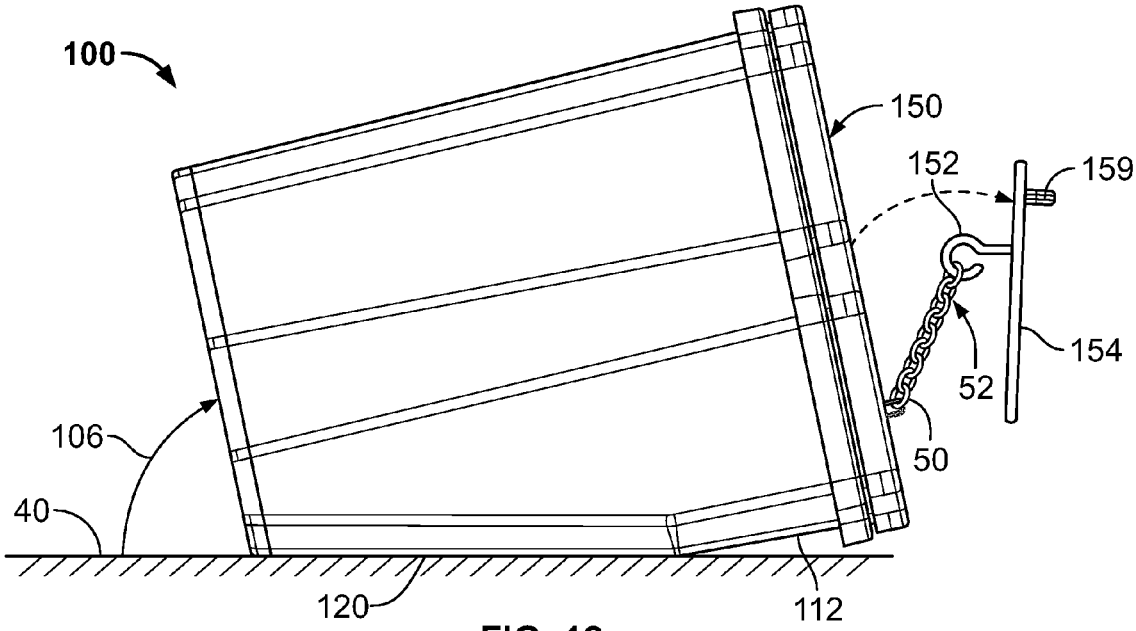

Referring now to FIGS. 11-12, in use, the container 100 can be readily adjusted between the storage position depicted in FIG. 11 (e.g., with the first bottom 115 adjacent to the shelf surface 40) and the display position depicted in FIG. 12 (e.g., with the secondary bottom surface 120 adjacent to the shelf surface 40). In some circumstances, such as when the container 100 is on a shelf or the support surface 40, the container 100 can be positioned at in the display position so that a product-dispensing window is oriented toward the consumer's line of sight (refer also to FIG. 2). When on the support surface 40, the space above the container 100 may be restricted due to the presence of an additional rack, or other display item. In these circumstances, it can be difficult for a consumer to view or withdraw chain from directly above the container 100 if the container is resting on its first bottom surface 115 (FIG. 11). However, when the container 100 is tilted or otherwise adjusted in the direction depicted by arrow 106 (FIG. 12), the container 100 can be oriented to provide ready access to the product-dispensing opening 170. In this embodiment, the container can be tilted at an angle that is less than 900, such as about 200 to about 800, about 500 to about 750, and about 600 to about 700 in this embodiment. After a worker tilts the container 100 to the display position shown in FIG. 12, the protruding structure 159 can be grasped and pulled to separate the removable portion 154 from the remainder of the lid 150. The free end 52 of the chain product 52 may be removably coupled to the eye-hook 152, so the end 52 of the chain product 50 can be conveniently withdrawn from the container 100 as the removable portion 154 is separated from the lid 150. In this orientation, the chain product 50 can be easily visualized and removed by a customer position proximate to the front of the shelf 40.

A number of embodiments of the invention have been described. Nevertheless, it will be understood that various modifications may be made without departing from the spirit and scope of the invention. For example, in other embodiments, the interior space 118 of the container 100 can receive an elongate bulk product other than the chain product 50, such as cable, wire, rope, cordage, or the like. In another example, some embodiments of the container may include a lid configured to be entirely removed to reveal the elongate bulk product 50 in the container body 110 after the container body 110 is tilted to the display position. Accordingly, other embodiments are within the scope of the following claims.

What is claimed is:

1. A transport and display container for an elongate chain product, comprising:

a container body that contains an elongate chain product, the container body being at least partially defined by a rim defining an opening to an interior space, a front wall, a rear wall, side walls, a first bottom wall that extends generally perpendicular to the front wall and rear wall, and a secondary bottom wall that extends transversely between the front wall and the first bottom wall for a length that is greater than a majority of a container body height defined between the first bottom wall and the rim; and a lid that is releasably engaged with the rim of the container body so as to at least partially enclose the elongate chain product therein, wherein container body is tiltable from a storage position in which the container body rests on the first bottom wall to a display position in which the container body rests on the secondary bottom wall so as to direct a chain-dispensing opening to face in a non-vertical orientation, wherein the container body defines a plurality of support channels that extend along the side walls from the bottom wall to the rim, the lid including concave side edge portions that are generally aligned with the plurality of support channels, and wherein the lid includes a retaining structure that defines a lower portion of the chain-dispensing opening, a concave region being formed between the retaining structure and a raised peripheral lip of the lid.

2. The container of claim 1, wherein the container body and lid provide a generally five-sided cross-sectional shape at least partially defined by the lid, front wall, the rear wall, the first bottom wall, and the secondary bottom wall.

3. The container of claim 1, wherein the first bottom wall extends in a horizontal direction when the container body is in the storage position, and the first bottom wall is extends in a non-horizontal direction when the container body is in the display position.

4. The container of claim 1, wherein when in the storage position, an opening defined by the container body faces in a vertical orientation and the lid releasably engages the container body to cover the opening.

5. The container of claim 4, wherein when in the display position, at least a portion of the lid is removable to reveal a chain-dispensing opening that faces in a non-vertical direction and that provides access to the elongate chain product arranged in the container body.

6. The container of claim 5, wherein the portion of the lid that is removable comprising a connection link that removable couples with a free end of the chain product contained in the container body.

7. A transport and display container for an elongate chain product, comprising:

a container body that contains an elongate chain product, the container body being at least partially defined by a front wall, a rear wall, side walls, a first bottom wall that extends generally perpendicular to the front wall and rear wall, and a secondary bottom wall that extends transversely between the front wall and the first bottom wall;

a lid that is releasably engaged with the container body so as to at least partially enclosed the elongate chain product therein; and three or more gripping handles integrally formed in the container body, wherein:

at least a first pair of the gripping handles are accessible to a user when the container body is arranged in the storage position, each of the first pair of handles including an upwardly extending cavity that opens in a direction toward of the first bottom wall, and at least a second pair of the gripping handles different from the first pair of the gripping handles are accessible to the user when the container body is arranged in the display position, each of the second pair of handles including an upwardly extending cavity that opens in a direction toward of the first bottom wall, wherein container body is tiltable from a storage position in which the container body rests on the first bottom wall to a display position in which the container body rests on the secondary bottom wall so as to direct a chain-dispensing opening to face in a non-vertical orientation, wherein when in the storage position, an opening defined by the container body faces in a vertical orientation and the lid releasably engages the container body to cover the opening, wherein when in the display position, a portion of the lid is removable to reveal a chain-dispensing opening that is defined by a remaining portion of the lid and that provides access to the elongate chain product arranged in the container body, wherein the portion of the lid that is removable comprising a connection link that removably couples with a free end of the chain product contained in the container body, and wherein the connection link draws the free end of the chain product out of the chain-dispensing opening when the portion of the lid is removed to reveal the chain-dispensing opening.

8. The container of claim 1, wherein the lid at least partially defines a recessed portion having a shape that corresponds to a lower portion of the container body opposite the lid.

9. The container of claim 8, wherein the lower portion of the container body is nestable within a recessed portion of a lid of an adjacent container in a stack of containers.

10. The container of claim 1, further comprising three or more gripping handles integrally formed in the container body, wherein:

at least a first pair of the gripping handles are accessible to a user when the container body is arranged in the storage position, each of the first pair of handles including an upwardly extending cavity that opens in a direction toward of the first bottom wall, and at least a second pair of the gripping handles different from the first pair of the gripping handles are accessible to the user when the container body is arranged in the display position, each of the second pair of handles including an upwardly extending cavity that opens in a direction toward of the first bottom wall.

11. The container of claim 10, wherein the second pair of gripping handles comprises at least one handle integrally formed in the first bottom wall of the container body.

12. A container for transporting and displaying an elongate bulk product, comprising:

a container body that contains an elongate bulk product in an interior space, the container body being at least partially defined by a front wall, a rear wall, side walls, a first bottom wall that extends generally perpendicular to the front wall and rear wall, a rim that is positioned generally opposite to the first bottom wall, and a secondary bottom wall that extends transversely between the front wall and the first bottom wall, wherein the secondary bottom wall terminates at a junction proximate to the front wall, the junction being positioned closer to the rim than the first bottom wall; and a lid that is releasably engaged with the rim of the container body so as to at least partially enclosed the elongate bulk product therein, at least a portion of the lid being removable to reveal a product-dispensing opening, wherein the container body is adjustable from a storage position in which the first bottom wall extends in a horizontal direction adjacent to a support surface to a display position in which the first bottom wall extends in a non-horizontal direction while secondary bottom wall is adjacent to the support surface, the product-dispensing opening facing in a forwardly tilted orientation when the container body is adjusted to the display position and the portion of the lid is removed; and three or more gripping handles integrally formed in the container body, wherein:

at least a first pair of the gripping handles are accessible to a user when the container body is arranged in the storage position, each of the first pair of handles including an upwardly extending cavity that opens in a direction toward of the first bottom wall, and at least a second pair of the gripping handles different from the first pair of the gripping handles are accessible to the user when the container body is arranged in the display position, each of the second pair of handles including an upwardly extending cavity that opens in a direction toward of the first bottom wall.

13. The container of claim 12, wherein a lower portion of the container body is nestable within a recessed portion of an adjacent container in a stack of containers.

14. The container of claim 12, wherein elongate bulk product contained in the container body comprises a length of chain material.

15. A method of handling elongate chain product in a chain container, comprising:

adjusting a chain container from a storage position in which a first bottom surface of the chain container is adjacent to a shelf surface to a display position in which a secondary bottom surface of the chain container is adjacent to the shelf surface, the chain container defining an interior space that contains an elongate chain product; and removing a portion of a lid of the chain container so as to reveal a chain-dispensing opening that is defined by a remaining portion of the lid and that provides access to the elongate chain product in the interior space, the chain-dispensing opening being arranged in a forwardly tilted orientation so that the elongate chain product is viewable to a consumer positioned proximate to a front of the shelf the surface, wherein the chain container includes three or more gripping handles integrally formed in a container body, wherein:

at least a first pair of the gripping handles are accessible to a user when the container body is arranged in a storage position, each of the first pair of handles including an upwardly extending cavity that opens in a direction toward of the first bottom surface, and at least a second pair of the gripping handles different from the first pair of the gripping handles are accessible to the user when the container body is arranged in the display position, each of the second pair of handles including an upwardly extending cavity that opens in a direction toward of the first bottom surface.

16. The method of claim 15, further comprising moving an adjacent container away from a nested position on top of the chain container before adjusting the chain container from the storage position to the display position.

17. The method of claim 15, wherein adjusting the chain container from the storage position to the display position comprises tilting the first bottom wall away from a horizontal orientation and to a non-horizontal orientation.

18. The method of claim 17, wherein adjusting the chain container from the storage position to the display position comprises exposing a bottom gripping handle on the first bottom surface of the chain container, the bottom griping handle being substantially concealed when the chain container is arranged in the storage position.

19. The method of claim 17, wherein adjusting the chain container from the storage position to the display position comprises tilting the secondary bottom wall away from a non-horizontal orientation and to a horizontal orientation.

20. The container of claim 7, wherein the lid at least partially defines a recessed portion having a shape that corresponds to a lower portion of the container body opposite the lid.

21. The container of claim 20, wherein the lower portion of the container body is nestable within a recessed portion of a lid of an adjacent container in a stack of containers.

22. A transport and display container for an elongate chain product, comprising:

container body that contains an elongate chain product, the container body being at least partially defined by a rim defining an opening to an interior space, a front wall, a rear wall, side walls, a first bottom wall that extends generally perpendicular to the front wall and rear wall, and a secondary bottom wall that extends transversely between the front wall and the first bottom wall for a length that is greater than a majority of a container body height defined between the first bottom wall and the rim; and a lid that is releasably engaged with the rim of the container body so as to at least partially enclose the elongate chain product therein, wherein container body is tiltable from a storage position in which the container body rests on the first bottom wall to a display position in which the container body rests on the secondary bottom wall so as to direct a chain-dispensing opening to face in a non-vertical orientation, wherein the container body defines a plurality of support channels that extend along the side walls from the bottom wall to the rim, the lid including concave side edge portions that are generally aligned with the plurality of support channels, wherein the removable portion of the lid includes a protruding structure to allow a force to be applied thereon to withdraw the removable portion from the remaining portion of the lid, and wherein the first bottom wall includes an indentation to receive a protruding structure of another transport and display container, when the other transport and display container is stacked under the first bottom wall of the present transport and display container.

* * * * *